US005945179A

United States Patent [19]

Gautreneau

[11] Patent Number: 5,945,179

[45] Date of Patent: Aug. 31, 1999

[54] PAPER TYPE OR SIMILAR SHEET SUBSTRATE FOR USING IN PRINTING OR REPRODUCTION PROCESSES

[76] Inventor: Pierre Gautreneau, 10, Allée des Comtesses, Esbly, France, 77450

[21] Appl. No.: 08/676,240

[22] PCT Filed: Jan. 18, 1994

[86] PCT No.: PCT/FR94/00054

§ 371 Date: Jul. 17, 1996

§ 102(e) Date: Jul. 17, 1996

[87] PCT Pub. No.: WO95/19268

PCT Pub. Date: Jul. 20, 1995

[51] Int. Cl.[6] ..... G09F 1/12

[52] U.S. Cl. ..... 428/14; 428/131

[58] Field of Search ..... 428/15, 131, 31, 428/33, 14

[56] References Cited

FOREIGN PATENT DOCUMENTS 2525370 10/1983 France .

1027382 4/1958 Germany .

2838028 3/1980 Germany .

2088613 6/1982 United Kingdom ..... 428/31

*Primary Examiner*—Henry F. Epstein

*Attorney, Agent, or Firm*—Greenblum & Bernstein, P.L.C.

[57] ABSTRACT

A paper type or similar sheet substrate for receiving an image in a printing or reproduction process. The sheet has a number of uniformly distributed holes, providing a paper which is transparent on one side and is capable of being applied to a glass pane. On the outside, the light illuminates the image and limits visibility of the holes; on the inside, the holes let the light through, making the document appear transparent. The transparency effect is advantageously reinforced by the application of a light-absorbing solid black area on the reverse. Depending on the printing or reproduction processed used, the perforated sheet can be associated with an unperforated sheet applied to its reverse side, thereby providing a lining sheet for the perforated sheet.

24 Claims, 2 Drawing Sheets

PAPER TYPE OR SIMILAR SHEET SUBSTRATE FOR USING IN PRINTING OR REPRODUCTION PROCESSES

BACKGROUND OF THE INVENTION

Field of the Invention

This invention relates to the general fields relating to communication and paper and more particularly a new paper type sheet-shaped support or similar element for receiving information or marking by means of printing or reproduction.

In FR-A 2 525 370, published on Oct. 21, 1983, which concerns an advertising medium for equipping all glazed surfaces without masking them, especially those of motor vehicles and taxis, there is a description of a medium whose material is printed and then perforated, the method being identical to the one for producing currently sold decorative sun-visors. The examples given do not describe any technical means able to respond to the questions posed, but, on the contrary, radically differ from the currently known technique in printing sectors.

In DE-A 28 38 028, published on Mar. 13, 1980, there is disclosed a method for feeding woven materials into printing machines sheet by sheet, this document solely concerning woven materials. The present invention, further described below, concerns a paper type print medium or the like whose characteristics cannot be assimilated with woven materials.

SUMMARY OF THE INVENTION

The present invention concerns a paper type sheet-shaped medium for printing or reproduction and formed of a sheet provided with a multitude of regularly distributed perforations and which provides a non-perforated integral portion constituting means able to have the medium picked up by the printing or reproduction material grasping system so as to obtain a one-face transparent paper able to be used as conventional expendable substance by said materials. The aforementioned two documents are, therefore, radically different from the principle of the present invention.

The support of the invention appears in the form of a paper type sheet or similar element provided with a multitude of regularly distributed perforations. This perforated sheet is intended to receive a visual display in the form of an informative, decorative or marking document by a conventional reproduction (reproduction graphics) or printing technique (offset, silk screen printing or other technique). Once marked on the front side, this support constitutes a one-face transparent paper i.e., one-way transparent paper able to be secured to a window, for example. On the outer side, the front side of this one face transparent paper is illuminated by the light: the visual display appears clearly and the perforations are not visible. On the inner side, the perforations allow the light to pass and the document appears approximately transparent. This transparency printing is advantageously reinforced by providing a colored flat tint on the back side (preferably black) which enables the light to be absorbed.

Surprisingly, the impact caused by the perforation technique used provides the paper sheet with greater rigidity and improves it resistance. In addition, the use of this technique significantly limits the influences of a hygrometric variation of the air on the evenness of the paper with respect to conventional full sheets.

This support makes it possible to obtain advertising posters, promotional cards, posters and sun visors which filter the light and thus no longer mask the clarity of glazed surfaces on the inner side.

The perforations of the sheet preferably have a surface area of close to 0.8 $mm^2$ and are advantageously distributed according to a density of about 20 to 30 per $cm^2$ in the form of a regular screen.

According to another disposition of the invention, the support comprises a non-perforated peripheral frame which reinforces its structure: this solid frame avoids any ill-timed tearing and any accidental deterioration of the material.

According to one particular embodiment, the sheet fitted with perforations comprises a non-perforated portion on at least one of its borders. This non-perforated portion is suitably disposed and has dimensions so that it extracts the sheet with the aid of traditional vacuum means of the printing or reproduction equipment. These, vacuum means are found on feeders for introducing the sheets of offset machines; they are used to pick up the sheet intended to be printed and transport it to the grippers to allow printing.

According to another disposition of the invention, the perforated paper sheet is associated with a second full sheet which doubles it and which is applied to its rear side. The two sheets have approximately the same dimensions and are rendered integral via at least one of their borders by any suitable device, such as a fold line or a line glueing or point glueing.

This full sheet is associated with the perforated sheet so as to facilitate or allow in certain cases, depending on the techniques used, the marking of the visual display on the recto of the support. Once the visual display has been transferred by printing or reproduction, the full doubling sheet is removed so as to obtain the one-face transparent paper i.e., one-way transparent paper.

As regards offset printing, this doubling sheet enables the support to be transferred by means of suction through the perforations.

In silk screen printing, it ensures that the support is kept on the suction table during printing and also ensures the recovery of the ink likely to pass through the perforations. For all these printing machines, the full doubling sheet facilitates the picking up and sliding of the supports with respect to one another at the level of the feeder. It provides the support with a smooth lower surface without which good distribution on a machine would not be obtained. It is to be noted that for the two printing techniques (offset and silk screen), the ink surplus not placed at the location of the perforations tends to become eliminated gradually on passage of the sheets; in fact, the perforations do not always appear at exactly the same place on the machine.

In reproduction graphic techniques, this full sheet ensures protection of the drum by recovering the inks passing through the perforations and secures them to this sheet at the time of the passage on cooking. In this way, the copiers do not undergo any crushing.

In addition, according to another disposition of the invention, the two superimposed sheets are rendered integral with each other at one of their borders and are bound or retained on the opposing border so that they can slide and move with respect to each other; this characteristic ensures a perfect rolling of the two sheets on the drum of colour laser type copiers. The sliding link may be obtained via an interlacing of upright notches provided on one of the sheets and oblique notches provided on the second.

BRIEF DESCRIPTION OF THE DRAWINGS

The invention is even more demonstrated without it being restrictive by the following description of several embodiments given by way of example and shown on the accompanying drawings on which.

DETAILED DESCRIPTION OF THE INVENTION

Figure 1:
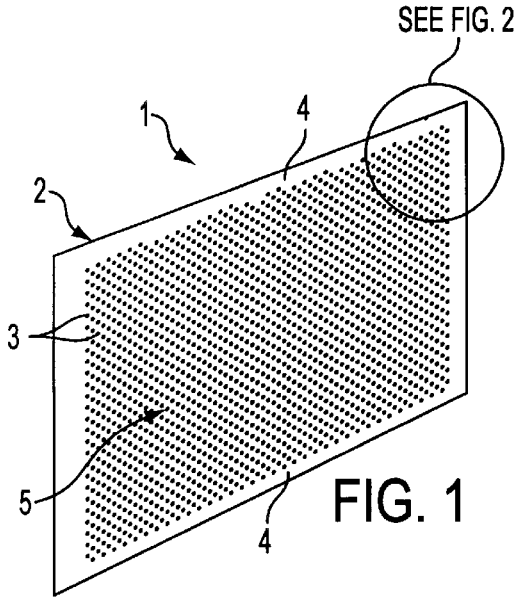
FIG. 1 is a perspective view of a possible embodiment of the paper support of the invention and intended to receive a marking by means of printing or reproduction.

As shown on FIG. 1, the support 1 of the invention is formed of a paper type sheet 2 or any other similar a rigid material. One of the faces of the sheet 2 (recto) is intended to be treated by means of printing or reproduction so as to apply to it any informative, decorative or advertising visual display. This paper sheet can have any type of format: 60×80, 40×60, 30×40 or 30×80, for example. Its paper weight may be between 80 and 150 g/m$^2$ and shall preferably be more than 100 g/m$^2$ so as to obtain a good quality one-face transparent paper.

The sheet 2 is subjected to a vertical embossing treatment by means of lines of punches so as to form a multitude of perforations 3. The perforation means are advantageously associated with a precise system for managing the running off of the paper material. The punching operation provides special properties of rigidity and resistance to humidity.

The surface of each circular perforation is about between 0.8 and 1 mm . These perforations are disposed by rows offset by one half-step with respect to one another so as to form a regular screen as shown on FIG. 2. So as to obtain a good quality one-face transparent paper, the perforations 3 are distributed according to a density of between 20 and 30 per cm$^2$ and preferably about 25 per cm$^2$. The perforations 3 normally occupy about ¼ of the surface of the paper.

Figure 2:
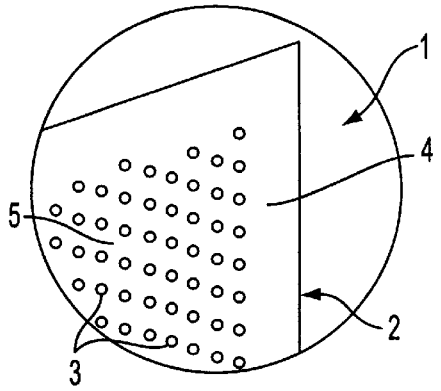
FIG. 2 is an enlarged view of a portion of this support.

FIGS. 1 and 2 show the presence of a frame 4 without any perforations and surrounding the perforated zone 5. This non-perforated frame 4 reinforces the structure of the sheet 2 and limits any ill-timed or accidental tearings linked to the perforations screen and in addition allows for gripping.

The recto of the sheet 2 preferably has a neutral color, such as white; depending on the desired visual display, it can also be tinted. Its verso is covered with a dark colored flat tint, preferably black, which permits optimum absorption of the light and which optimises the transparency of this side of the support.

Figure 3:
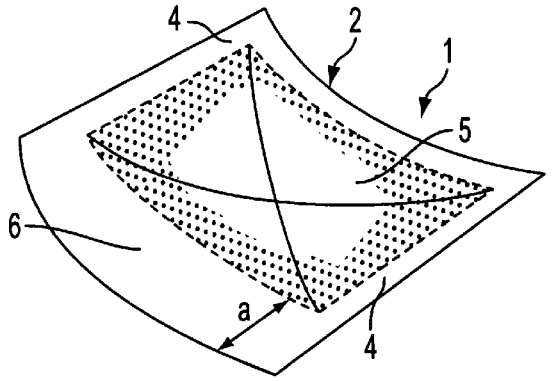
FIG. 3 is a perspective view of another possible embodiment of the support.

FIG. 3 shows a support 1 according to the invention and able to be used for an offset printing. This support 1 is formed of a sheet 2 provided with a zone of perforations 5 diagrammatized by the crossed framing, said perforated zone 5 being surrounded by a non-perforated frame 4. On one of its sides, the width a frame 4 is larger. The corresponding portion 6 without any perforations is located inside the zone which corresponds to the location of picking up of the sheet by the suction means of the equipment transfer system.

A perforated sheet of this type can be used for printing. The ink of the printing roller, which is not laid on the support at the level of the perforations, is eliminated during passage of the following sheets as, owing to the size of the spacings of the perforations screen, the holes are not always present are the same place on the machine.

Figure 4:
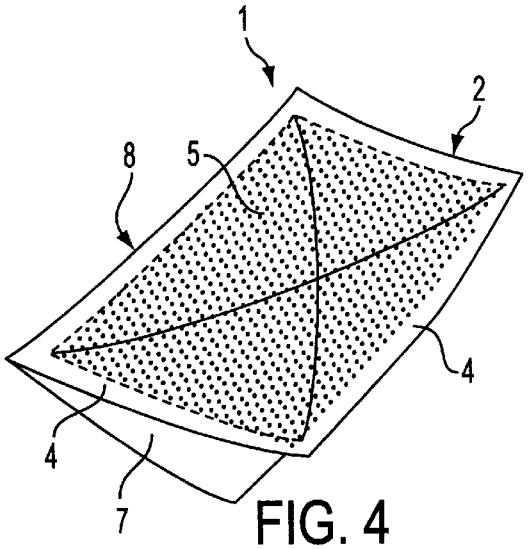
FIG. 4 shows another embodiment example of the support and constituted by a perforated sheet associated with a full doubling sheet.

As shown on FIG. 4, the support 1 of the invention can be formed of a perforated sheet 2 of the same type as the one shown on FIG. 1 and associated with a full sheet 7 used for doubling and applied to its verso.

The doubling sheet 7 is rendered integral with the perforated sheet 2 so as to be able to be easily removed after transfer of the display. FIG. 4 shows the full sheet 7 slightly standing back under the perforated sheet 2. The aim of this representation is to clearly show the structure of the support 1: in reality and at the time it is used, the two sheets 2 and 7 are clad onto each other over their entire surface so as to obtain two layers of superimposed materials.

The two sheets 2 and 7 have the same dimensions and are rendered integral with each other by at least one of their borders.

According to one possible embodiment, they are identical and the support 1 is obtained from a single paper sheet (paper weight: 135 g/m$^2$ for example) folded at its middle. In this case, the means 8 for rendering integral the two sheets 2 and 7 are located on one of their borders and consist of a single fold line. In the context of this disclosure, the term "integral" refers to the sheets 2 and 7 being unitary, i.e., made as one-piece, as shown in the drawing. Only one portion of the basic sheet undergoes a perforation treatment and a flat-colored tint is affixed to its verso.

In another embodiment, the full doubling sheet 7 can also be directly mounted and rendered integral by glue points or lines on one or several borders of the perforated sheet 2. The doubling 7 can then have a particular nature and in particular a paper weight differing from that of the perforated sheet 2.

The perforated sheet/full sheet complex obtained can be used in an offset or silk screen printing machine. For silk screen printing, the doubling 7 makes it possible to recover the ink which would pass through the perforations and it also ensures that the support is maintained on the machine during printing. For these two techniques, the full sheet is also intended to enable the sheets to be transported by means of suction through the perforations. In addition, it provides smoothness for the lower surface of the support which facilitates its sliding and separation from the stored pile awaiting printing.

The reproduction graphic technique, for certain types of copiers and in particular color laser copiers, requires that the paper be wound onto one portion of the outer surface of the drum. The obtaining of a quality copy passes through a correct transfer of polarity and a good cooking. However, these characteristics are not easy to obtain for thick supports made up of two superimposed sheets due to the non-homogeneity of the structure and the need to provide an easily destructible rendering integral system. In fact, if the two sheets are rendered integral via just one of their sides, their weight requires that they be separated on the opposite side. Secondly, if they are rendered integral over their entire periphery, the winding of the paper on the drum results in a curling of the internal sheet.

Figure 5A:
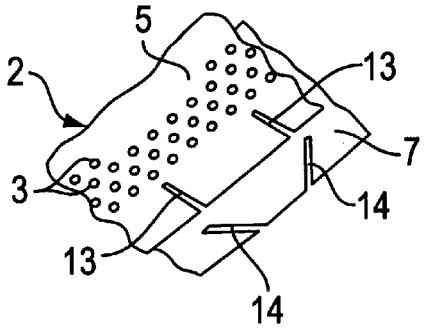
FIGS. 5*a* and 5*b* show the sliding linking means able to be provided to bind one of the sides of the sheets doubling.
Figure 5B:
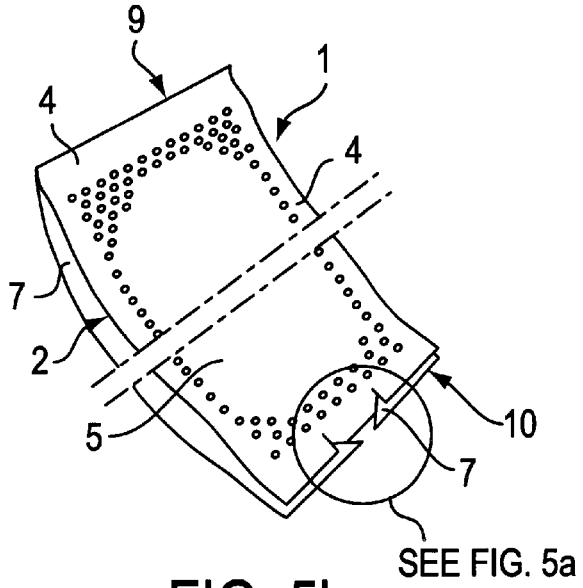
Figure 6:
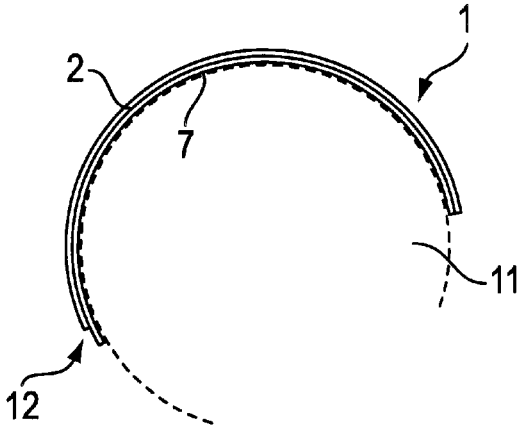
FIG. 6 is a side view of the result of this link on winding of the sheets superimposed on a copier drum.

So as to overcome this drawback and as shown on FIGS. 5*a*, 5*b* and 6, the perforated sheet 2 and the doubling sheet 7 are rendered integral on their introduction border 9 by any suitable fold line or glueing device and bind them and retain them on their opposing border 10 so that the two sheets 2 and 7 can slide perfectly with respect to each other. The two superimposed sheets are then permanently clad against each other but can still move with respect to each other which absorbs the bend effects.

FIG. 6 shows the position of the sheets complex on a copier drum type roller 11. It also shows the slight movement or offsetting 12 inherent with the bend at the level of the sliding link of the sheets.

This type of link can be obtained by any suitable device and in particular, as shown on FIGS. 5*a* and 5*b,* by means of the upright notches 13 on one of the sheets 2 associated with the oblique notches 14 on the second sheet 7. In the context of this disclosure, the term "upright" refers to the notches 13 extending perpendicularly, or substantially perpendicularly, to the border 10, as shown in the drawing. Likewise, the term "oblique" refers to notches 14 extending obliquely (i.e., at an angle other than perpendicular) to the border 10). The corresponding cuts are engaged into one another and interlaced by suitable cylindrical-shaped mechanical means fitted with snugs, for example.

This type of link may also be obtained by folding down by folding the extremity of one of the two sheets onto the second sheet over its entire width or of both the two sheets or simply by folding down their two opposing corners having the same width by a fold at 45° over a length of between 10 and 20 mm.

As for the silk screen printing technique, the doubling sheet 7 provided on the support used in reproduction graphics makes it possible to recover the inks which passes through the perforations. These inks are secured to doubling at the time of entering cooking and the copier does not undergo any crushing.

The nature of the support, its structure and its format are selected according to the type of printing or reproduction it is desired to use. In all cases, after transfer of the display onto the support, the latter can be applied to any glazed surface so as to become visible from the outside which providing it with transparency on the inside so as to see the outside.

I claim:

1. At least one sheet for use in printing and reproduction techniques, comprising:

a first portion and a second portion, said first portion comprising a multitude of regularly distributed perforations and being one-way transparent, said second portion comprising an integral non-perforated portion, said non-perforated portion comprising a means for enabling said sheet to be picked up by a grasping system of printing or reproduction equipment utilized in said techniques.

2. At least one sheet according to claim 1, wherein:

said at least one sheet comprises a plurality of borders; and said non-perforated portion comprises at least one of said borders of said at least one sheet, said non-perforated portion having dimensions suitable for enabling said at least one sheet to be picked up by a vacuum grasping means of said printing or reproduction equipment.

3. At least one sheet according to claim 1, wherein:

said first portion having perforations comprising a first sheet; and said at least one sheet further includes a second, full sheet applied to a verso of said first sheet, said first and second sheets are integral with respect to each other at a common border, said first and second sheets being linked at respective borders, both of said respective borders being opposite to said common border, to facilitate sliding of said first and second sheets with respect to each other.

4. At least one sheet according to claim 3, wherein:

said first and second sheets are linked by means of at least two notches in one of said sheets extending perpendicularly or substantially perpendicularly to one of said respective borders, and at least two notches in the other of said sheets extending obliquely to the other of said respective borders, said notches of said first sheet being interlaced with said notches of said second sheet to facilitate said sliding of said first and second sheets with respect to each other.

5. At least one sheet according to claim 3, wherein:

said perforations of said at least one sheet have respective surface areas of about between 0.8 and 1.0 $mm^2$ and said perforations are distributed on said at least one sheet according to a density of about 20 to 30 per $cm^2$ in the form of a regular screen.

6. At least one sheet according to claim 3, wherein:

said at least one sheet has a recto adapted to receive a display by means of printing or reproduction equipment; and said at least one sheet has a verso covered with a colored flat tint for absorbing light.

7. At least one sheet according to claim 1, wherein:

said perforations of said at least one sheet have respective surface areas of about between 0.8 and 1.0 $mm^2$ and said perforations are distributed on said at least one sheet according to a density of about 20 to 30 per $cm^2$ in the form of a regular screen.

8. At least one sheet according to claim 7, wherein:

said at least one sheet has a recto adapted to receive a display by means of printing or reproduction equipment; and said at least one sheet has a verso covered with a colored flat tint for absorbing light.

9. At least one sheet according to claim 1, wherein:

said perforations of said at least one sheet have respective surface areas of about 0.8 $mm^2$ and said perforations are distributed on said at least one sheet according to a density of about 25 per $cm^2$ in the form of a regular screen.

10. At least one sheet according to claim 1, wherein:

said at least one sheet further includes a non-perforated peripheral frame surrounding said perforations.

11. At least one sheet according to claim 1, wherein:

said at least one sheet has a recto adapted to receive a display by means of printing or reproduction equipment; and said at least one sheet has a verso covered with a colored flat tint for absorbing light.

12. At least one sheet according to claim 11, wherein:

said flat tint is black.

13. At least one sheet according to claim 1, wherein:

said perforated first portion on neither a recto nor a verso includes any applied image.

14. At least one sheet according to claim 1, wherein:

said at least one sheet comprises paper.

15. A one-way transparent paper comprising:

at least one sheet for use in printing and reproduction techniques, said at least one sheet comprising:

a first portion and a second portion, said first portion comprising a multitude of regularly distributed perforations and being one-way transparent, said second portion comprising an integral non-perforated portion, said non-perforated portion comprising a means for enabling said at least one sheet to be picked up by a grasping system of printing or reproduction equipment utilized in said techniques; and an informative, decorative, or other visual display applied to said perforated first portion of said at least one sheet.

16. A one-way transparent paper according to claim 15, wherein:

said at least one sheet comprises a plurality of borders;

said non-perforated portion comprises at least one of said borders of said at least one sheet, said non-perforated portion having dimensions suitable for enabling said at least one sheet to be picked up by a vacuum grasping means of said printing or reproduction equipment.

17. A one-way transparent paper according to claim 15, wherein:

said first portion having perforations comprising a first sheet; and said at least one sheet further includes a second, full sheet applied to a verso of said first sheet, said first and second sheets are integral with respect to each other at a common border, said first and second sheets being linked at respective borders, both of said respective borders being opposite to said common border, to facilitate sliding of said first and second sheets with respect to each other.

18. A one-way transparent paper according to claim 17, wherein:

said first and second sheets are linked by means of at least two notches in one of said sheets extending perpendicularly or substantially perpendicularly to one of said respective borders, and at least two notches in the other of said sheets extending obliquely to the other of said respective borders, said notches of said first sheet being interlaced with said notches of said second sheet to facilitate said sliding of said first and second sheets with respect to each other.

19. A one-way transparent paper according to claim 15, wherein:

said perforations of said at least one sheet have respective surface areas of about between 0.8 and 1.0 $mm^2$ and said perforations are distributed on said at least one sheet according to a density of about 20 to 30 $cm^2$ in the form of a regular screen.

20. A one-way transparent paper according to claim 15, wherein:

said at least one sheet further includes a non-perforated peripheral frame surrounding said perforations.

21. A one-way transparent paper according to claim 15, wherein:

said at least one sheet has a recto adapted to receive a display by means of printing or reproduction equipment; and said at least one sheet has a verso covered with a colored flat tint for absorbing light.

22. A one-way transparent paper according to claim 21, wherein:

said flat tint is black.

23. A one-way transparent paper according to claim 15, wherein:

said perforated first portion on neither a recto nor a verso includes any applied image.

24. A one-way transparent paper according to claim 15, wherein:

said at least one sheet comprises paper.

* * * * *